United States Patent [19]

Tetreault

[11] Patent Number: 4,795,366

[45] Date of Patent: Jan. 3, 1989

[54] ELECTRICAL CONNECTOR HANDLE

[75] Inventor: Joseph E. Tetreault, Norwell, Mass.

[73] Assignee: High Voltage Engineering Corporation, Burlington, Mass.

[21] Appl. No.: 117,447

[22] Filed: Nov. 2, 1987

Related U.S. Application Data

[63] Continuation of Ser. No. 779,705, Sep. 24, 1985, abandoned.

[51] Int. Cl.[4] ..... H01R 13/516

[52] U.S. Cl. ..... 439/476; 439/490

[58] Field of Search ..... 439/476, 478, 480, 490

[56] References Cited

U.S. PATENT DOCUMENTS 2,754,488 7/1956 Horn ..... 339/108 R 3,196,424 7/1965 Hardesty et al. ..... 339/113 L X

*Primary Examiner*—Eugene F. Desmond

*Attorney, Agent, or Firm*—Richard J. Birch

[57] ABSTRACT

An electrical connector handle for use with a plural cable electrical connector assembly. The handle has a pair of D-shaped, spade handles extending rearwardly from a housing that releasably retains the electrical cable-connector assembly. An integral cable strain relief is provided together with cable control switches and a power condition indicator.

5 Claims, 4 Drawing Sheets

ELECTRICAL CONNECTOR HANDLE

This is a continuation of co-pending application Ser. No. 779,705 filed on Sept. 24, 1985 now abandoned.

BACKGROUND OF THE INVENTION

The present invention relates to electrical connectors in general, and more particularly, to a handle for use with a plural contact electrical connector having attached thereto a corresponding plurality of electrical cables.

In the aircraft industry, ground power is provided to aircraft at the flight line through a plug-in electrical connector that is supplied electrical power through a plurality of cables. Typically, the cable connector assembly is configured as a festoon that is mounted in serpentine fashion on one or more festoons attached to the outer walls of the telescoping passageway. The festoon electrical cable and connector are extended and retracted from a power-actuated pay-out device. Power-actuated extention and retraction of the connector cable assembly is desirable because of the weight of the cables and connector.

The environmental conditions surrounding an aircraft on the flight line are extremely severe. The ground powered electrical cables and connector are subject to mechanical abrasion, rain and snow, and the deleterious impact of exposure to a variety of chemicals including de-icing compounds, gasoline, JP-4 fuel and hydraulic fluids. Under such conditions, it is desirable to keep the head end of the electrical connector off of the ground and away from rain puddles and chemical spills.

The head end of the ground power cable electrical connector is plugged into a mating electrical connector positioned behind a hatch on the aircraft fuselage. Often times, the aircraft's electrical connector is located well above the ground level and beyond the reach of the flight line attendant. In these situations, the heavy electrical cables and connector must be dragged up onto a platform and then electrically coupled to the aircraft. Even under the best of weather conditions, the operation is difficult.

It is accordingly a general object of the present invention to provide a handle for electrical connectors.

It is a specific object of the invention to provide a handle for an electrical connector having a pair of D-shaped, spade handles to facilitate manipulation of the heavy electrical connector.

It is still another object of the present invention to provide a handle for an electrical connector that has a configuration which prevents the head end of the connector from touching the ground when the handle connector and electrical cables are on the ground.

It is a feature of the invention that the handle provides a visual indication of the power condition of the ground supplied electrical power to the aircraft.

It is another feature of the invention that the power indication is provided at the point of electrical contact between the electrical connector and the aircraft's mating connector.

It is still another feature of the invention that the control of the extension and retraction of the ground power electrical cable can be controlled from the electrical connector handle.

These objects and other objects and features of the invention will best be understood from a detailed description of a preferred embodiment thereof, selected for purposes of illustration and shown in the accompanying drawings in which.

DETAILED DESCRIPTION OF THE INVENTION

Figure 4:
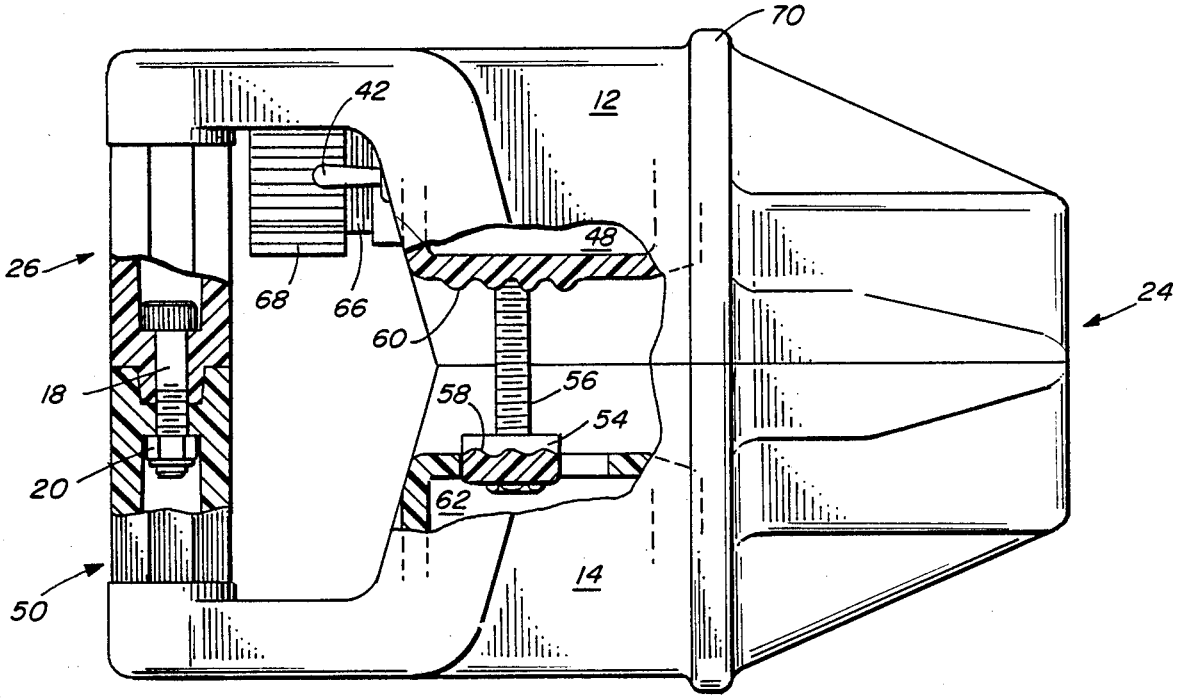
FIG. 4 is a view in side elevation and partial section showing the cable clamping arrangement of the electrical connector handle.

Turning now to the drawings, there is shown an electrical connector handle constructed in accordance with the present invention and indicated generally by the reference numeral 10. The connector handle comprises an upper housing half 12 and a lower housing half 14 which collectively form a housing 16. The two housing halves 12 and 14 are secured together by means of threaded fasteners 18 and corresponding nuts 20 as best seen in FIG. 4. In addition, fasteners 22 are used to secure the forwards portions of the housing halves together.

Figure 3:
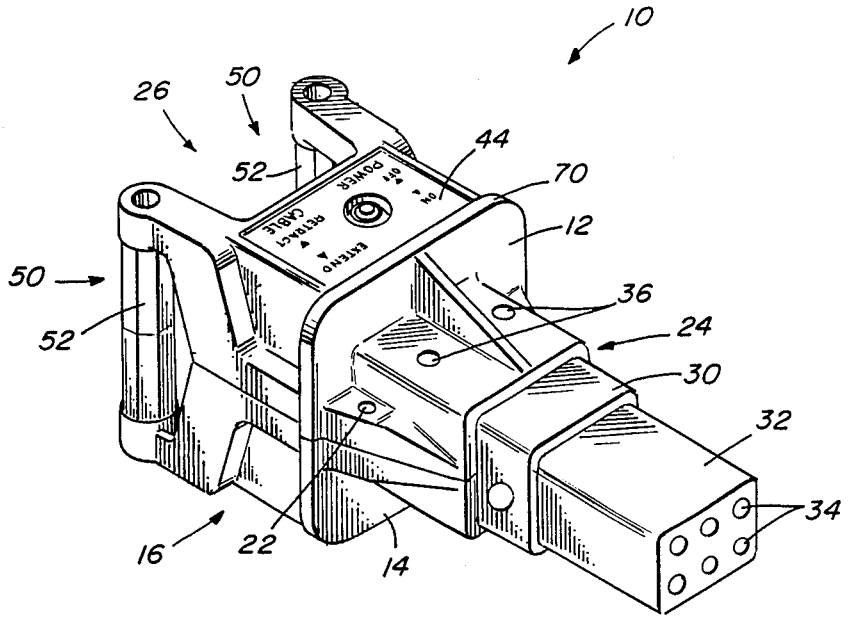
FIG. 3 is a view in perspective showing the handle in use with an electrical connector.

The housing 16 has a front end 24 and a back end 26 as shown in FIG. 3. At the front end 24, the housing 16 defines an electrical connector receiving socket 28 (FIG. 1) that is adapted to receive an electrical connector 30 having a head end portion 32 with a plurality of electrical contact receiving apertures 34. The electrical connector 30 is releasably secured with respect to the housing 16 by means of fasteners 36. By way of illustration only, the electrical connector 30 can be a six-pole portable plug Model R-67 sold by the Anderson Power Products division of High Voltage Engineering Corporation, 145 Newton Street, Boston, Mass. 02135.

Figure 6:
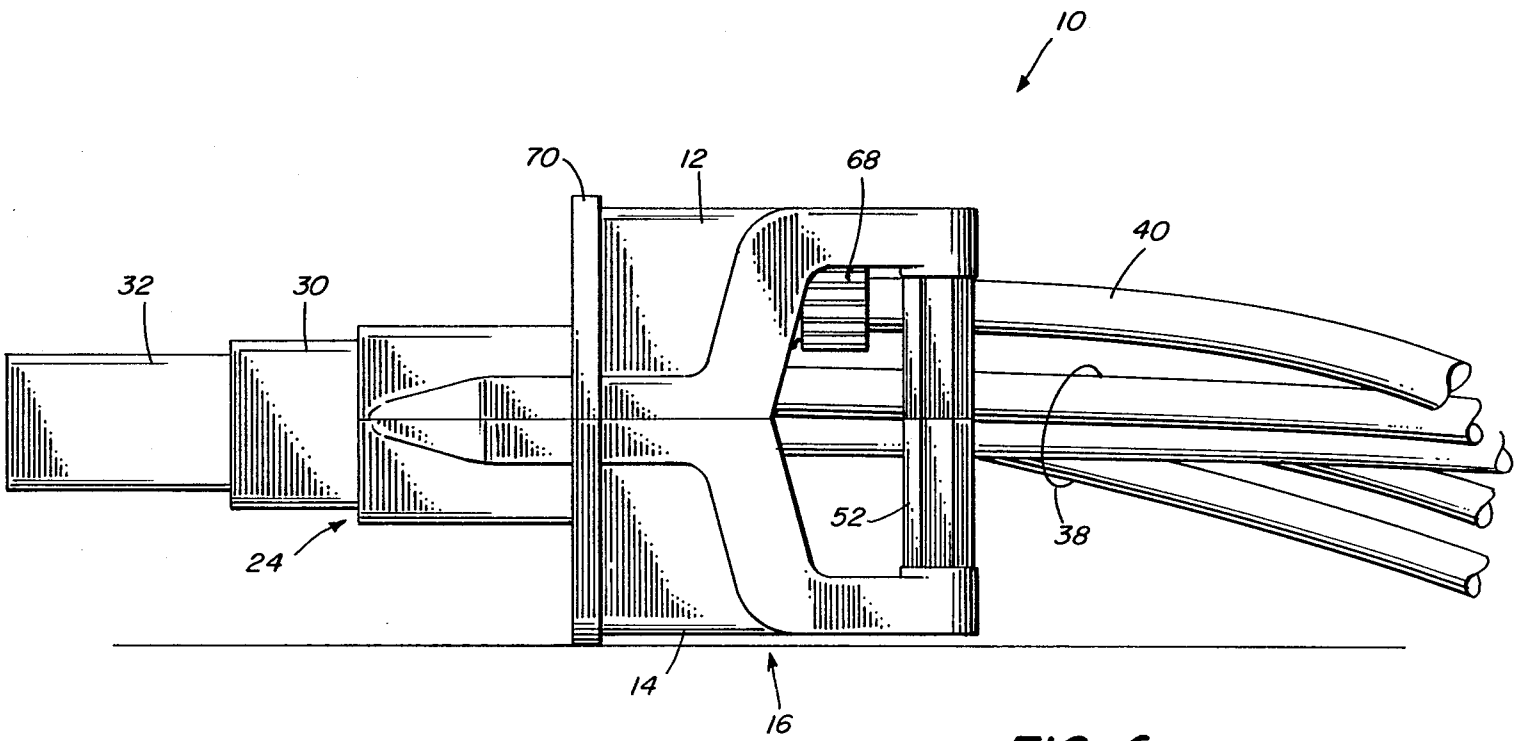

The electrical connector 30 is connected to a plurality of ground power cables 38 (FIG. 6). Typically, the cables supply three-phase 400 cycle alternating current to the aircraft through four cables; three three-phase power cables and a neutral cable. The remaining two poles of the electrical connector generally are either jumpered at the connector or jumpered at the corresponding aircraft electrical connector (not shown).

Figure 1:
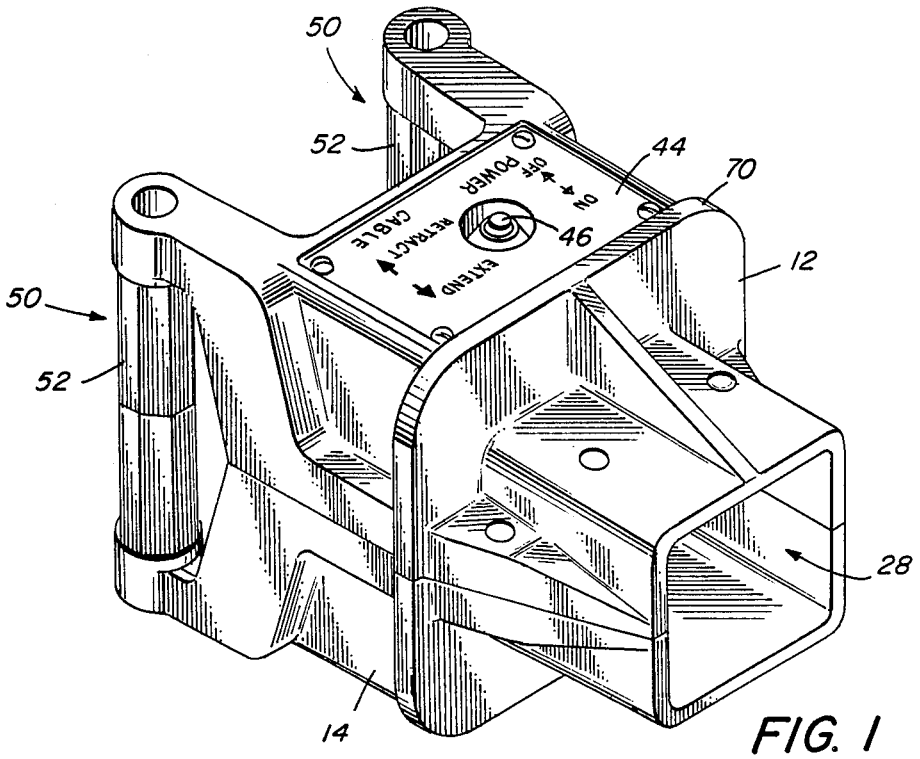
FIG. 1 is a top-right side perspective view of the handle of the present invention.
Figure 2:
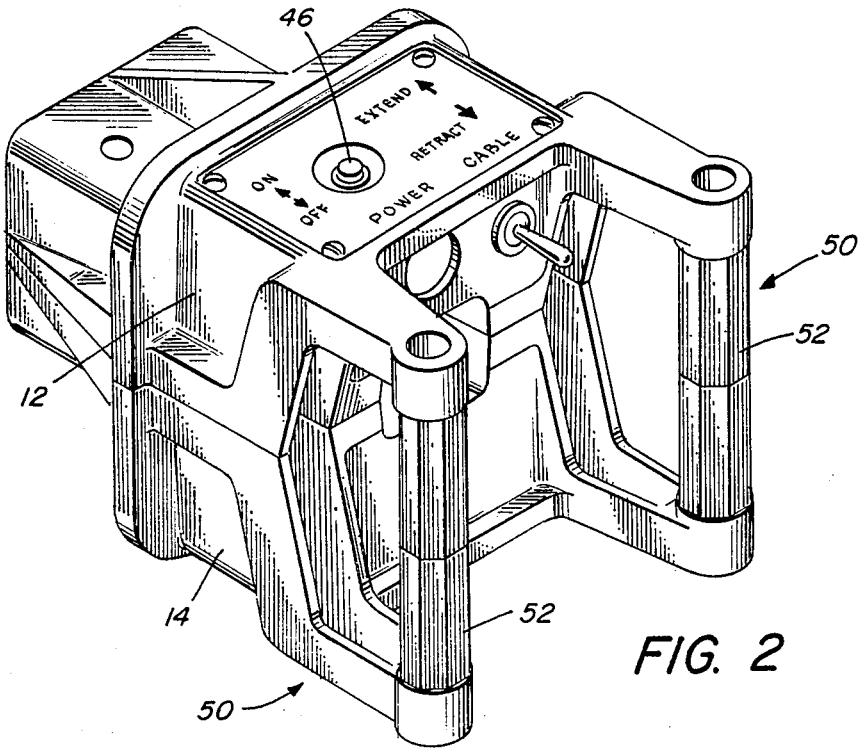
FIG. 2 is a top-left hand, back perspective view of the handle of FIG. 1.

In addition to the ground power cables 38, a control cable 40 is connected to the handle 10 to provide functional control of different electrical circuits through one or more switches 42. As shown in FIGS. 1 and 2, a control plate 44 is secured to the upper handle housing half. The control plate 44 provides a visual indication of the action of switch or switches 42. As shown in the Figures, cable extension and retraction is controlled through a center-off spring loaded switch 42. A corresponding switch without a center-off position (not shown) is mounted on the upper housing half to control the ON-OFF condition of ground electrical power to the aircraft. A recessed visual power indicator, such as a LED 46, is placed adjacent to the ON-OFF labels on the control plate 44 and is illuminated whenever the power cables 38 are energized with ground power. The electrical components, namely, switch or switches 42 and indicator 46, are contained within an electrical components cavity 48 located in the upper housing half and best seen in FIG. 4.

It has already been mentioned that the ground power cables and electrical connector are heavy and awkward to handle and many times are used under adverse environmental conditions and are subject to the deleterious effects of a variety of chemicals. In order to facilitate the handling and manipulation of the heavy cables and connector, the electrical connector handle 10 includes a pair of D-shaped "spade" handles extending rearwardly from the back end 26 of housing 16 with a handle positioned on each side of the electrical cables. The D-shaped handles 48, preferably have a octagonally shaped gripping area 52 to ease the handling of the electrical connector and cables secured within the two housing halves.

Figure 5:
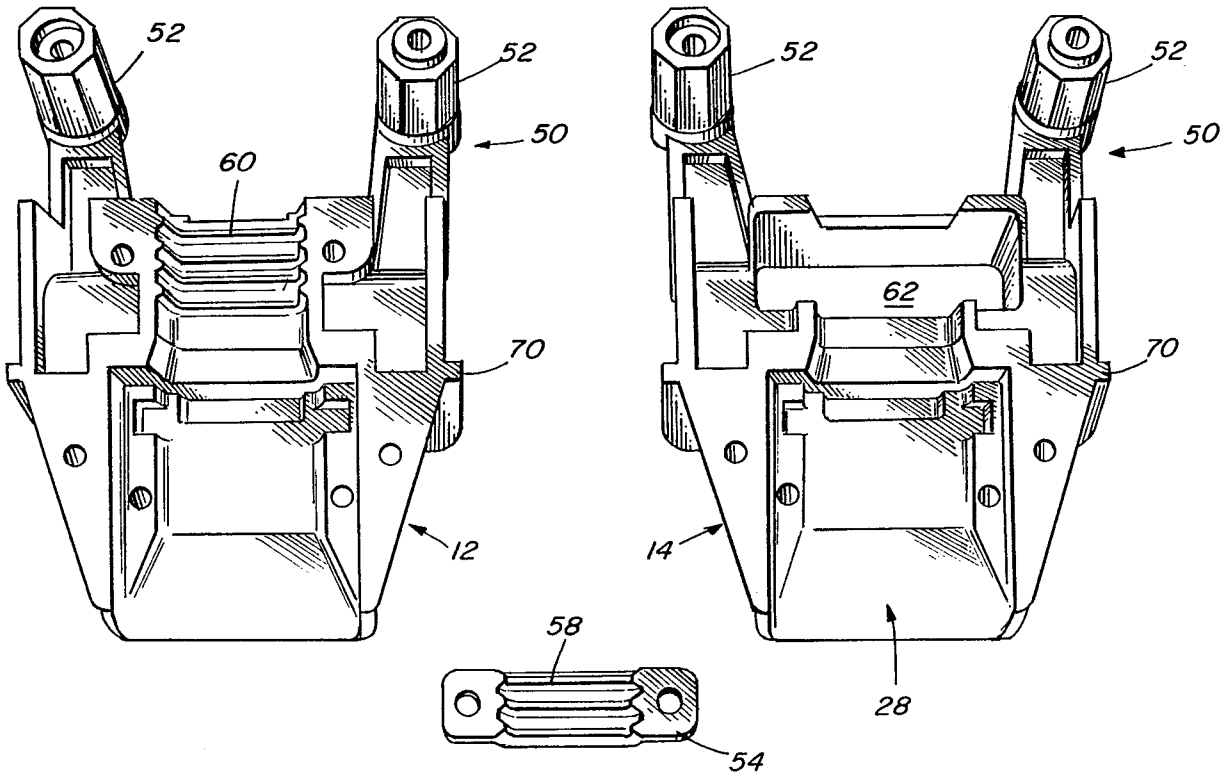
FIG. 5 is a perspective view of the upper and lower housing halves of the handle and the cable clamp; and, FIG. 6 is a view in side elevation illustrating the location of the handle flange to prevent contact of the connector head with the ground.

Given the weight of the cables, considerable strain is imposed upon the electrical connector when it is attached to the aircraft. The handle 10 of the present invention provides an integral strain relief for the ground power cables 38. Looking at FIGS. 4 and 5, a cable clamp 54 is adjustably secured with respect to the upper housing half by means of a threaded fastener 56. The cable clamp has a plurality of cable gripping ribs 58 which cooperate with corresponding ribs 60 located in the upper housing half 12 to securely, yet releasably, restrain the cables with respect to the handle 10. Access to the cable clamp fasteners for fastening and loosening the clamp is provided through a cable clamp cavity 62 located in the lower housing half 14.

The control cable 40 also is releasably secured with respect to the handle 10. Looking at FIGS. 2 and 4, the upper housing half 12 has a control cable aperture 64 through which is threaded a conduit 66 (FIG. 4). A gasketed threaded bushing 68 provides a water tight securement of the control cable with respect to the electrical connector handle 10.

Referring now to FIG. 6, there is shown in side elevation the electrical connector handle of the present invention used in conjunction with the ground power electrical cable-connector assembly. The electrical connector 30 is shown with its head portion 32 positioned above the surface of the ground. This positioning of the head portion of the electrical connector is achieved by means of a flange 70 that extends around and outwardly from the housing 16. The flange 70, preferably, has a generally rectilinear shape so that the handle will not roll and will maintain the electrical connector head 32 in a position off of the ground when the handle is resting on the ground, regardless of the handles orientation. The location of the transversely extending flange 70 with respect to a longitudinal housing axis extending between the front and back ends 24 and 26 of the handle, is selected so that the combined weight of the electrical cables and connector will tilt the handle downwardly in a rearward direction when the handle, cables and connector are resting on the ground.

Although the preceding detailed description of the invention has been made in connection with a handle having two housing halves, namely the upper and lower housing halves 12 and 14, respectively, it will be appreciated that the handle 10 can be constructed with a single molded housing. However, it should be noted that the dual housing half configuration does facilitate retrofitting of existing ground power cable-connector assemblies on the flight line.

Having described in detail a preferred embodiment of my invention, it will now be obvious to those skilled in the art that numerous modifications can be made therein without departing from the scope of the invention as defined in the following claims.

What I claim and desire to secure by Letters of Patent of the United States is:

1. An electrical connector handle for use with a plural contact electrical connector having a plurality of electrical cables connected at one end thereof, said electrical connetor handle comprising:

1. A housing having a front end, a back end, means defining a bore extending longitudinally through said housing, said bore defining means including a portion that forms an electrical connector receiving socket and, a pair of D-shaped, spade handles located at the back end of the housing with one D-shaped spade handle positioned on each side of said longitudinally extending bore defining means, said D-shaped, spade handles lying in planes that are substantially parallel to each other and substantially parallel to the longitudinal axis of the longitudinally extending bore of said housing;
2. a generally rectangular flange means extending around and outwardly from the housing, said flange means being located transversely of an axis extending longitudinally between the front end and the back end of the housing;
3. means for removably retaining said electrical connector in said electrical connector receiving socket; and,
4. electrical cable clamp means adapted to cooperate with said housing to releasably clamp the plurality of electrical cables with respect to the housing.

2. The electrical connector handle of claim 1 wherein said transverse located flange means is positioned at a point along the longitudinal axis extending between front and back ends of the electrical connector so that when the handle is used with the plural contact electrical connector and the plurality of electrical cables connected at one end thereof the combined weight of the handle, connector and electrical cables is sufficient to maintain the other end of the electrical connector at a point above the flange means in the gravity direction when the handle and electrical cables are on the ground.

3. The electrical connector handle of claim 1 further comprising means for indicating the energization state of the plurality of electrical cables.

4. An electrical connector handle for use with a plural contact electrical connector having a plurality of electrical cables connected at one end thereof, said electrical connector handle comprising:

1. first and second housing halves adapted to be secured together to form a housing having a front end and a back end and a longitudinal axis extending therebetween, said first and second housing halves cooperatively defining when secured together,
   (a) an electrical connector receiving means for receiving and removably retaining the plural contact electrical connector with at least a portion of the electrical connector extending outwardly from the front end of the housing formed by the first and second housing halves;
   (b) a pair of D-shaped, spade handles located at the back end of the housing formed by the first and second housing halves said D-shaped, spade handles lying in planes that are substantially parallel to each other and substantially parallel to said longitudinal axis;

(c) a generally rectangular flange means extending around and outwardly from the housing formed by the first and second housing halves located transversely of an axis between the front and back ends of the housing;

2. electrical cable clamp means adapted to cooperate with at least one of said housing halves to releasably clamp the plurality of electrical cables with respect to the housing formed by said first and second housing halves; and, 3. means for removably securing said first and second housing halves together.

5. The electrical connector handle of claim 4 wherein said transverse located flange means is positioned at a point along the longitudinal axis extending between front and back ends of the electrical connector so that when the handle is used with the plural contact electrical connector and the plurality of electrical cables connected at one end thereof the combined weight of the handle, connector and electrical cables is sufficient to maintain the other end of the electrical connector at a point above the flange means in the gravity direction when the handle and electrical cables are on the ground.

* * * * *